US005153662A

United States Patent [19]

Foos

[11] Patent Number: 5,153,662

[45] Date of Patent: Oct. 6, 1992

[54] SHEET DECURLING APPARATUS

[75] Inventor: Gary M. Foos, Williamson, N.Y.

[73] Assignee: Xerox Corporation, Stamford, Conn.

[21] Appl. No.: 864,273

[22] Filed: Apr. 6, 1992

[51] Int. Cl.[5] ..... G03G 21/00

[52] U.S. Cl. ..... 355/309; 162/271; 355/282; 355/308

[58] Field of Search ..... 355/309, 204, 308, 200, 355/208, 282, 285, 289, 290, 295; 162/270, 271; 271/278, 302, 303, 209, 188

[56] References Cited

U.S. PATENT DOCUMENTS

| | | | |
|---|---|---|---|
| 1,969,073 | 8/1934 | Hamre | 92/70 |
| 3,546,067 | 12/1970 | Heidepriem | 162/271 |
| 3,661,703 | 5/1972 | Shelor | 162/271 |
| 3,865,364 | 2/1975 | Sterner | 271/105 |
| 4,119,309 | 10/1978 | Mayer et al. | 162/271 X |
| 4,326,915 | 4/1982 | Mutschler, Jr. | 162/271 |
| 4,505,695 | 3/1985 | Billings | 493/459 |
| 4,539,072 | 9/1985 | Frye et al. | 162/197 |
| 4,561,645 | 12/1985 | Pollich | 271/195 |
| 4,591,259 | 5/1986 | Kuo et al. | 355/309 |
| 4,627,718 | 12/1986 | Wyer | 355/311 |
| 4,652,110 | 3/1987 | Sato et al. | 355/282 X |
| 4,926,358 | 5/1990 | Tani et al. | 364/562 |
| 4,952,281 | 8/1990 | Akira | 162/270 |
| 4,963,943 | 10/1990 | Tamary | 355/290 |
| 4,977,432 | 12/1990 | Coombs et al. | 355/309 |
| 5,017,970 | 5/1991 | Sakata | 355/290 |
| 5,075,734 | 12/1991 | Durland et al. | 355/312 |
| 5,084,731 | 1/1992 | Baruch | 355/208 |

*Primary Examiner*—A. T. Grimley
*Assistant Examiner*—Sandra L. Brasé
*Attorney, Agent, or Firm*—Paul J. Maginot

[57] ABSTRACT

An apparatus for decurling an advancing sheet is disclosed. The apparatus includes a first belt and a second belt spaced apart from the first belt so as to define a space adapted to receive the advancing sheet. The apparatus further includes a roller positioned between the first belt and the second belt, the roller being in contact with the first belt in a first mode of operation so as to define a first nip and being in contact with the second belt in a second mode of operation so as to define a second nip.

8 Claims, 3 Drawing Sheets

SHEET DECURLING APPARATUS

This invention relates generally to an apparatus for improving the quality of a sheet, and more particularly concerns an apparatus for decurling a sheet.

A curl or bend may be created in a sheet as a result of its method of manufacture. In addition, a problem which sometimes occurs in a printing machine such as an electrophotographic printing machine is the development of a curl or bend in the sheet as the sheet passes through the various processing stations of the printing machine.

A curled sheet may be undesirable from a variety of standpoints. For instance, the curled sheet may be difficult to handle as the sheet is processed in a printing machine. Curled sheets may tend to produce jams or misfeeds within the printing machine. Additionally, sheets having a curl or bend therein may be esthetically undesirable to consumers thereof.

The following disclosures may be relevant to various aspects of the present invention.

U.S. Pat. No. 1,969,073; Patentee: Hamre; Issued: Aug. 7, 1934.

U.S. Pat. No. 3,865,364; Patentee: Sterner; Issued: Feb. 11, 1975.

U.S. Pat. No. 4,326,915; Patentee: Mutschler, Jr.; Issued Apr. 27, 1982.

U.S. Pat. No. 4,505,695; Patentee: Billings; Issued: Mar. 19, 1985.

U.S. Pat. No. 4,539,072; Patentee: Frye et al.; Issued: Sep. 3, 1985.

U.S. Pat. No. 4,561,645; Patentee: Pollich; Issued: Dec. 31, 1985.

U.S. Pat. No. 4,627,718; Patentee: Wyer; Issued: Dec. 9, 1986.

U.S. Pat. No. 4,926,358; Patentee: Tani et al.; Issued: May 15, 1990.

U.S. Pat. No. 4,952,281; Patentee: Akira; Issued: Aug. 28, 1990.

U.S. Pat. No. 4,963,943; Patentee: Tamary; Issued: Oct. 16, 1990.

U.S. Pat. No. 4,977,432; Patentee: Coombs et al.; Issued: Dec. 11, 1990.

U.S. Pat. No. 5,017,970; Patentee: Sakata; Issued: May 21, 1991.

U.S. Pat. No. 5,084,731; Patentee: Baruch; Issued: Jan. 28, 1992.

In accordance with one aspect of the present invention, there is provided an apparatus for decurling an advancing sheet. The apparatus includes a first belt and a second belt spaced apart from the first belt so as to define a space adapted to receive the advancing sheet. The apparatus further includes a roller positioned between the first belt and the second belt, the roller being in contact with the first belt in a first mode of operation so as to define a first nip and being in contact with the second belt in a second mode of operation so as to define a second nip.

Other features of the present invention will become apparent as the following description proceeds and upon reference to the drawings, in which.

Figure 1:
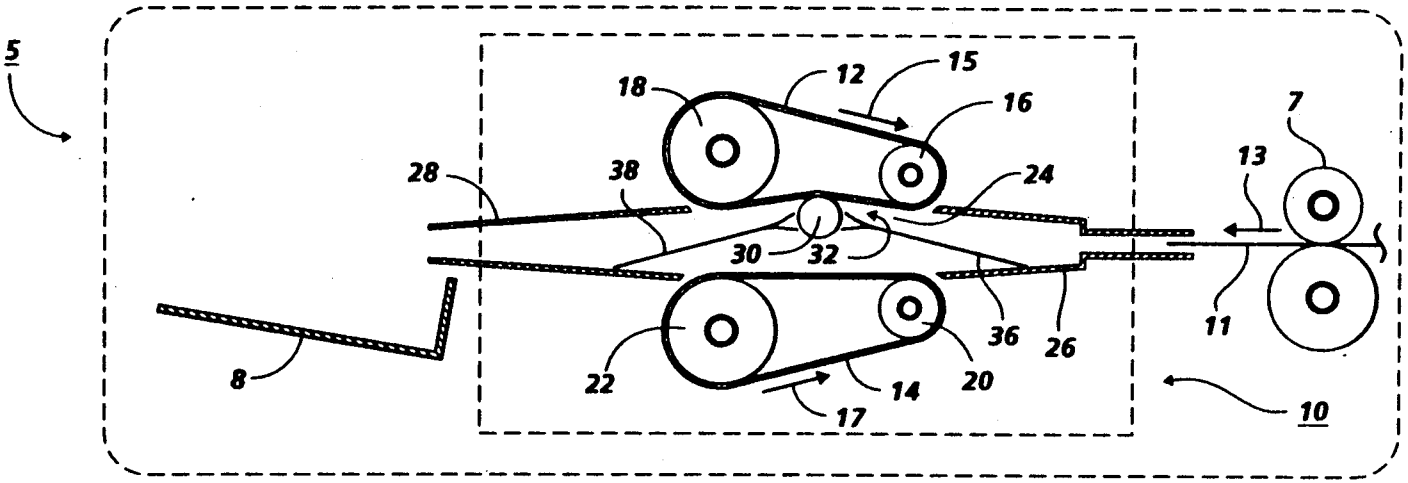
FIG. 1 is a schematic elevational view showing a sheet decurling apparatus of a printing machine incorporating the features of the present invention therein, with the roller of the sheet decurling apparatus positioned in the first mode of operation and at a first penetration setting.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further applications of the principles of the invention as illustrated therein being contemplated as would normally occur to one skilled in the art to which the invention relates.

In FIG. 1 of the drawings, there is shown a printing machine, generally indicated by the reference numeral 5. The printing machine may be an electrophotographic printing machine such as the printing machine described in U.S. Pat. No. 5,075,734 issued to Durland et al., the disclosure of which is hereby incorporated by reference. The printing machine includes a fuser apparatus 7, an output catch tray 8 and a sheet decurling apparatus, generally indicated by the reference numeral 10. The sheet decurling apparatus 10 receives a sheet 11, traveling in the direction of the arrow 13, from the output of the fuser apparatus 7. The sheet decurling apparatus 10 then physically acts on the sheet to reduce the amount of curl therein and subsequently guides the sheet to the output catch tray 8 for subsequent removal therefrom by a machine operator.

Figure 2:
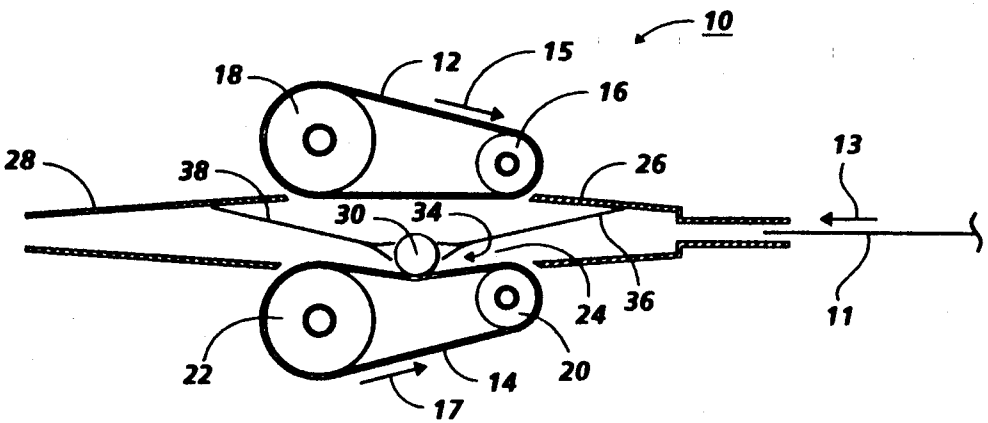
FIG. 2 is a schematic elevational view showing the sheet decurling apparatus of FIG. 1, with the roller of the sheet decurling apparatus positioned in the second mode of operation and at the first penetration setting.
Figure 3:
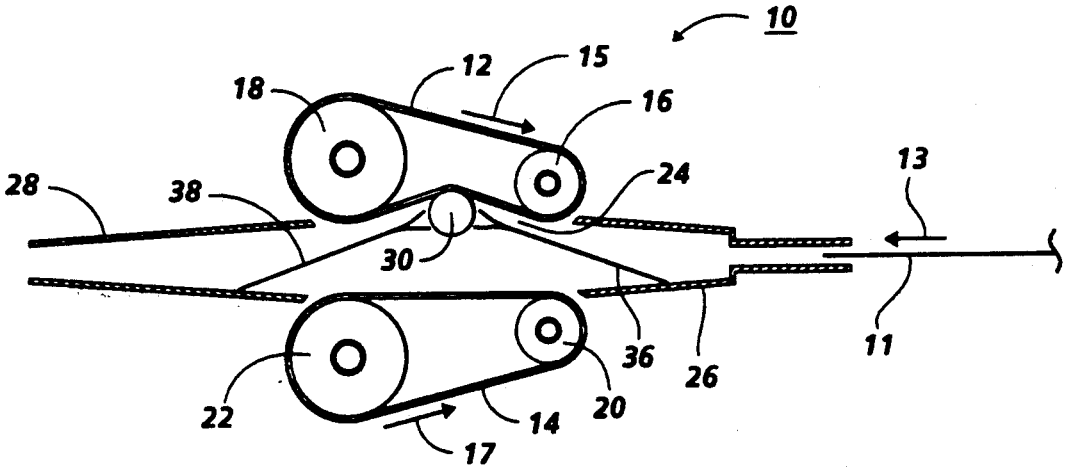
FIG. 3 is a schematic elevational view showing the sheet decurling apparatus of FIG. 1, with the roller of the sheet decurling apparatus positioned in the first mode of operation and at a second penetration setting.
Figure 4:
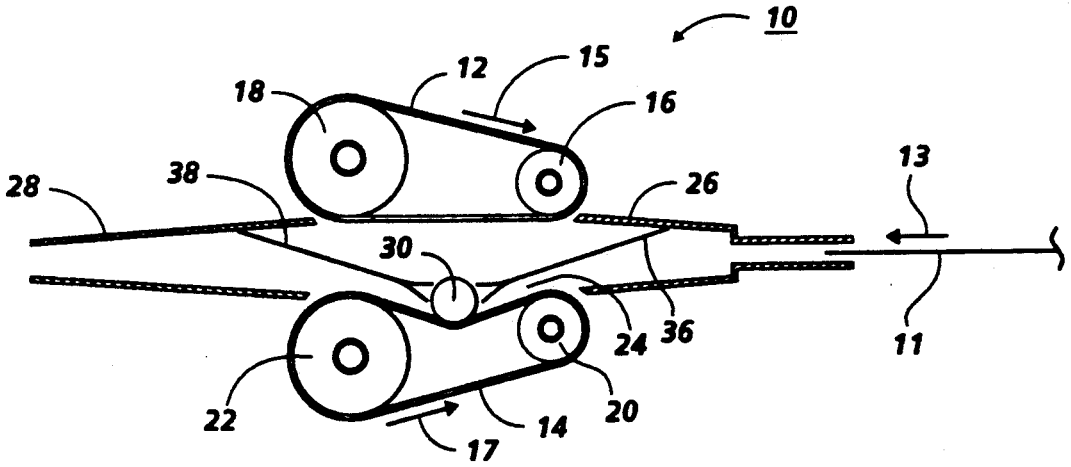
FIG. 4 is a schematic elevational view showing the sheet decurling apparatus of FIG. 1, with the roller of the sheet decurling apparatus positioned in the second mode of operation and at the second penetration setting.
Figure 5:
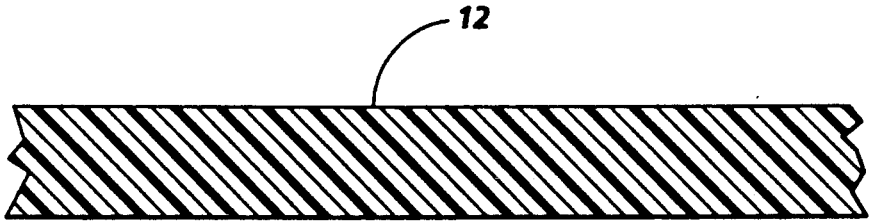
FIG. 5 is a fragmentary sectional view of the first belt of the sheet decurling apparatus of FIG. 1.
Figure 6:
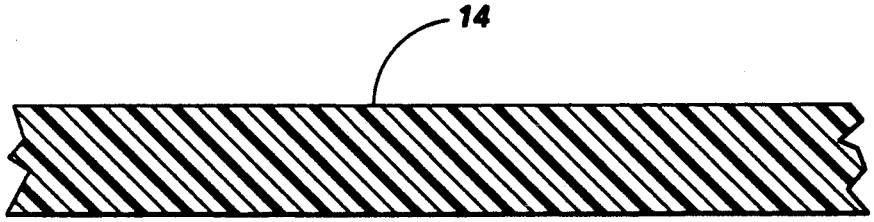
FIG. 6 is a fragmentary sectional view of the second belt of the sheet decurling apparatus of FIG. 1.

The sheet decurling apparatus 10 is described below in more detail. In particular, the sheet decurling apparatus includes a first belt 12 and a second belt 14. The first belt 12 and the second belt 14 are each made from a polyurethane material (see FIGS. 5 and 6). The first belt 12 is entrained about a first pair of shafts 16 and 18 while the second belt 14 is entrained about a second pair of shafts 20 and 22. A motor (not shown) is mechanically coupled to the shaft 18 thereby causing shaft 18 to rotate. As shaft 18 rotates, belt 12 is advanced in the direction of arrow 15. The motor is also mechanically coupled to the shaft 22 thereby causing shaft 22 to rotate. As shaft 22 rotates, belt 14 is advanced in the direction of arrow 17. The first belt 12 is spaced apart from the second belt 14 so as to define a space 24 through which sheet 11 is advanced. The sheet decurling apparatus 10 further includes a roller 30 which is positioned within space 24. The roller 30 is positionable to contact the first belt 12 in a first mode of operation so as to define a first nip 32 as shown in FIG. 1. In the first mode of operation, the roller 30 is spaced apart from the second belt 14. The roller 30 is further positionable to contact the second belt 14 in a second mode of operation so as to define a second nip 34 as shown in FIG. 2. In the second mode of operation, the roller 30 is spaced apart from the first belt 12.

Positioned substantially adjacent the first belt 12 and the second belt 14 at one location is a stationary inlet baffle 26 (see FIGS. 1–4). Also, positioned substantially adjacent the first belt 12 and the second belt 14 at another location is a stationary outlet baffle 28 (see also FIGS. 1–4). A movable inlet baffle 36 is located partially within the stationary inlet baffle 26 and is positionable at a first orientation, as shown in FIG. 1, to guide the advancing sheet into the first nip 32 in response to the roller 30 being positioned in the first mode of operation. The movable inlet baffle 36 is also positionable at a second orientation, as shown in FIG. 2, to guide the advancing sheet into the second nip 34 in response to the roller 30 being positioned in the second mode of operation. Moreover, a movable outlet baffle 38 is located partially within the stationary outlet baffle 28. The movable outlet baffle 38 is positionable at a first orientation, as shown in FIG. 1, to guide the advancing sheet out of the first nip 32 in response to the roller 30 being positioned in the first mode of operation. The movable outlet baffle 38 is also positionable at a second orientation, as shown in FIG. 2, to guide the advancing sheet out of the second nip 34 in response to the roller 30 being positioned in the second mode of operation.

The roller 30 is movable to penetrate against the first belt 12 at one of a plurality of penetration or force settings. The roller 30 is shown being forced against the first belt 12 in FIG. 1 at a first penetration or force setting while the roller 30 is shown being forced against the first belt 12 in FIG. 3 at a second penetration or force setting. The roller 30 is shown being forced against the first belt 12 with a greater amount force in FIG. 3 than in FIG. 1. Moreover, the roller 30 is movable to penetrate against the second belt 14 at one of a plurality of penetration or force settings. The roller 30 is shown being forced against the second belt 14 in FIG. 2 at a first penetration or force setting while the roller 30 is shown being forced against the second belt 14 in FIG. 4 at a second penetration or force setting. The printing machine 5 may be equipped with a mechanism (not shown) which allows the machine operator to manually adjust the roller 30 to a desired penetration or force setting against the first belt 12 or second belt 14, or the printing machine may incorporate a mechanism (not shown), including a control system, which automatically adjusts the roller 30 to a desirable penetration or force setting against the first belt 12 or the second belt 14 in response to various sensed characteristics of the sheet such as the magnitude of curl in the sheet, the amount of toner on the sheet, and the size and orientation of the sheet.

While the invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected.

I claim:

1. An apparatus for decurling an advancing sheet, comprising:

a first belt;

a second belt spaced apart from said first belt so as to define a space adapted to receive the advancing sheet; and a roller positioned between said first belt and said second belt, said roller being in contact with said first belt in a first mode of operation so as to define a first nip and being in contact with said second belt in a second mode of operation so as to define a second nip.

2. The apparatus of claim 1, further comprising an inlet baffle positionable at a first orientation to guide the advancing sheet into the first nip in response to said roller being positioned in the first mode of operation and at a second orientation to guide the advancing sheet into the second nip in response to said roller being positioned in the second mode of operation.

3. The apparatus of claim 2, further comprising an outlet baffle positionable at a first orientation to guide the advancing sheet out of the first nip in response to said roller being positioned in the first mode of operation and at a second orientation to guide the advancing sheet out of the second nip in response to said roller being positioned in the second mode of operation.

4. The apparatus of claim 1, wherein said first belt comprises a polyurethane material.

5. The apparatus of claim 4, wherein said second belt comprises a polyurethane material.

6. The apparatus of claim 1, wherein said first belt is entrained about a first pair of spaced apart shafts.

7. The apparatus of claim 6, wherein said second belt is entrained about a second pair of spaced apart shafts.

8. The apparatus of claim 1, wherein said roller is spaced apart from said second belt in the first mode of operation and is spaced apart from said first belt in the second mode of operation.

* * * * *